US010208449B2

(12) United States Patent
Ruckel

(10) Patent No.: US 10,208,449 B2
(45) Date of Patent: Feb. 19, 2019

(54) TEMPORARY MANHOLE COVER AND METHOD

(71) Applicant: Daniel Ruckel, Jeffersonville, IN (US)

(72) Inventor: Daniel Ruckel, Jeffersonville, IN (US)

( * ) Notice: Subject to any disclaimer, the term of this patent is extended or adjusted under 35 U.S.C. 154(b) by 67 days.

(21) Appl. No.: 15/607,464

(22) Filed: May 27, 2017

(65) Prior Publication Data

US 2017/0342676 A1 Nov. 30, 2017

Related U.S. Application Data

(60) Provisional application No. 62/342,354, filed on May 27, 2016.

(51) Int. Cl.
*E02D 29/14* (2006.01)
*E02D 29/12* (2006.01)

(52) U.S. Cl.
CPC ..... *E02D 29/1409* (2013.01); *E02D 29/12* (2013.01); *E02D 29/14* (2013.01); *E02D 2200/1607* (2013.01); *E02D 2220/00* (2013.01); *E02D 2300/0035* (2013.01)

(58) Field of Classification Search
CPC ..... E02D 29/14
USPC ..... 404/25, 26; 52/19, 20, 21
See application file for complete search history.

(56) References Cited

U.S. PATENT DOCUMENTS 1,744,278 A * 1/1930 Merriman ..... E03F 5/046 404/5
3,385,011 A * 5/1968 Sorrell ..... B66F 19/005 294/90
3,621,623 A * 11/1971 Downes ..... E02D 29/124 138/96 R
4,935,129 A * 6/1990 Wang ..... B01D 29/05 114/182
5,024,550 A * 6/1991 Mainville ..... E03F 5/06 210/163
5,066,165 A * 11/1991 Wofford ..... E03F 3/046 404/4

(Continued)

FOREIGN PATENT DOCUMENTS

CA 2656748 A1 * 8/2010 ..... E02D 29/14
FR 3000752 A1 * 7/2014 ..... E02D 29/14

(Continued)

*Primary Examiner* — Thomas B Will
*Assistant Examiner* — Katherine J Chu
(74) *Attorney, Agent, or Firm* — Roberts IP Law; John Roberts

(57) ABSTRACT

A temporary manhole cover and its methods of use are configured to prevent an entire person from falling into a manhole, while providing a unique structure, adjustable in some embodiments, that allows access for a user to simultaneously reach through and/or pass objects through the temporary manhole cover when it is installed in a manhole. The structure may include an annular perimeter portion optionally having an L-shaped cross-section defining a circular interior opening there-through, a first set of two parallel laterally-separated cross-members each attached with and extending across the circular opening, and a second set of two parallel laterally-separated cross-members each extending perpendicularly between and attached with the first set of two parallel laterally-separated cross-members.

11 Claims, 1 Drawing Sheet

(56) References Cited

U.S. PATENT DOCUMENTS

| | | | | | |
|---|---|---|---|---|---|
| 5,150,984 | A * | 9/1992 | Bowman | E02D 29/124 | 404/26 |
| 5,328,294 | A * | 7/1994 | Miller | E02D 29/1445 | 249/145 |
| 5,529,431 | A | 6/1996 | Walth | | |
| 6,854,922 | B1 * | 2/2005 | Nicks | E02D 29/1427 | 404/25 |
| 6,893,186 | B1 * | 5/2005 | Tello, Sr. | E02D 29/14 | 404/25 |
| 7,303,354 | B1 * | 12/2007 | DeCroix | E02D 29/14 | 404/25 |
| 2007/0286676 | A1 * | 12/2007 | Auckland | E02D 29/127 | 404/25 |
| 2016/0168818 | A1 * | 6/2016 | Harazim | E02D 29/14 | 404/25 |
| 2018/0058032 | A1 * | 3/2018 | Harazim | E02D 29/1463 | |

FOREIGN PATENT DOCUMENTS

| | | | | |
|---|---|---|---|---|
| JP | 2003105789 | A * | 4/2003 | |
| KR | 200205760 | Y1 * | 12/2000 | |
| WO | WO-2015015050 | A1 * | 2/2015 | E01F 13/02 |

* cited by examiner

TEMPORARY MANHOLE COVER AND METHOD

CROSS-REFERENCE TO RELATED APPLICATIONS

This application claims priority to, incorporates herein by reference, and is a non-provisional of U.S. Patent Application No. 62/342,354, filed May 27, 2016 ("the '354 Application").

FEDERALLY SPONSORED RESEARCH OR DEVELOPMENT

None.

TECHNICAL FIELD

The present invention relates to manhole covers, and more particularly to temporary manhole covers and methods that prevent an entire human body from falling into a manhole while providing a unique structure that allows access for a user to reach through and/or pass objects through the temporary manhole cover.

BACKGROUND

The following U.S. patent is incorporated herein by reference in its entirety: U.S. Pat. No. 5,529,431 A, issued Jun. 25, 1996 to Walsh, entitled Temporary Manhole Cover and Method (herein "Walsh"). Walsh provides background information regarding manholes and manhole covers, and proposes a temporary solution for allowing air and light into a manhole while preventing any tools or other large objects from accidentally falling down the open manhole and hitting the worker. See Walsh, Col. 2, lines 30-35. While the art teaches temporary manhole covers that allow light and air to pass through while protecting workers and others from any injury, Applicant has found that a need exists for a solution that would allow workers' hands and tools to readily pass into and out of the manhole while still preventing the severe injuries that could occur if a worker's entire body were to fall into the manhole.

SUMMARY

The present invention(s) elegantly overcome many of the drawbacks of prior systems and provide numerous additional improvements and benefits as will be apparent to persons of skill in the art. Provided in various example embodiments is a temporary manhole cover that may comprise, or alternatively consist of, an annular perimeter portion defining a vertically-extending cylindrical wall configured to fit closely within and to engage a circular manhole opening; a horizontally-extending shelf extending radially inward from a top edge of the vertically-extending cylindrical wall to an inner profile surface and defining an interior opening there-through; a first set of two parallel laterally-separated cross-members, each attached with and extending from a first side of the horizontally-extending shelf, across the interior opening, to and attached with a second side of the horizontally-extending shelf; a second set of two parallel laterally-separated cross-members, each extending perpendicularly from and attached with a first one of the first set of two parallel laterally-separated cross-members, across an interior portion of the interior opening, to and attached with a second one of the first set of two parallel laterally-separated cross-members.

The temporary manhole cover may define a plurality of openings there-through, including: a first opening defined between the inner profile surface and the first one of the first set of two parallel laterally-separated cross-members; a second opening defined between the inner profile surface and the second one of the first set of two parallel laterally-separated cross-members; a third opening defined between the first set of two parallel laterally-separated cross-members and between the second set of two parallel laterally-separated cross-members; a fourth opening defined between the inner profile surface, the first set of two parallel laterally-separated cross-members, and a first one of the second set of two parallel laterally-separated cross-members; and a fifth opening defined between the inner profile surface, the first set of two parallel laterally-separated cross-members, and a second one of the second set of two parallel laterally-separated cross-members; wherein at least two of the plurality of openings are sufficiently large that a user can pass a hand of the user there-through, while none of the plurality of openings are sufficiently large that an entire body of the user can pass there-through.

In various example embodiments, the inner profile surface defines a round interior opening. In various example embodiments the second set of two parallel laterally-separated cross-members are each removably attachable with the first set of two parallel laterally-separated cross-members at a plurality of different predetermined locations on the first set of two parallel laterally-separated cross-members. In various example embodiments the annular perimeter portion includes an L-shaped cross-section. In various example embodiments the first set of two parallel laterally-separated cross-members each includes an L-shaped cross-section. In various example embodiments the second set of two parallel laterally-separated cross-members each includes a U-shaped cross-section. In various example embodiments the first set of two parallel laterally-separated cross-members are each formed from angle aluminum. In various example embodiments the second set of two parallel laterally-separated cross-members are each formed from C-channel aluminum. In various example embodiments, no part of the temporary manhole cover extends vertically downward below a bottommost surface of the vertically-extending cylindrical wall of the annular perimeter portion.

Also provided in various example embodiments is a method of using a temporary manhole cover, comprising the steps of: removing a manhole cover from a manhole; placing on the manhole a temporary manhole cover as recited herein; reaching a user's hand through any of the plurality of openings in the temporary manhole cover, while simultaneously another object at least the size of the user's hand is extending through any other of the plurality of openings in the temporary manhole cover. Further provided in various example embodiments is a method comprising the steps of removing at least one of the second set of two parallel laterally-separated cross-members from a first predetermined location on the first set of two parallel laterally-separated cross-members and attaching the at least one of the second set of two parallel laterally-separated cross-members at a second predetermined location on the first set of two parallel laterally-separated cross-members.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure. It will be understood that certain components and details may not appear in the Figure(s) to assist in more clearly describing the invention.

FIG. 1 A-A is a section view of the example temporary manhole cover of FIG. 1 along line A-A.

FIG. 1 B-B is a section view of the example temporary manhole cover of FIG. 1 along line B-B.

DETAILED DESCRIPTION OF EXAMPLE EMBODIMENTS

Reference is made herein to some specific examples of the present invention, including any best modes contemplated by the inventor for carrying out the invention. Examples of these specific embodiments are discussed above in the Summary and illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. The terms circular, parallel, and perpendicular mean generally circular, generally parallel, and generally perpendicular. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Figure 2:
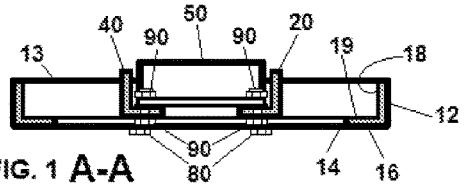
FIG. 2 is a right side elevation view of the example temporary manhole cover of FIG. 1.
Figure 2:
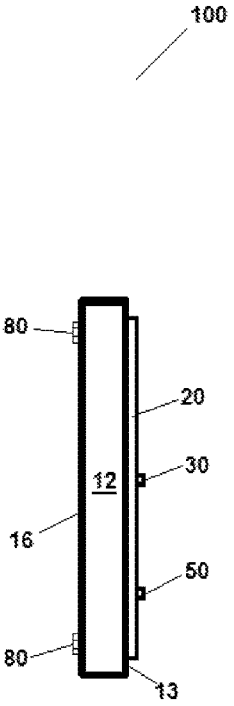
Figure 1:
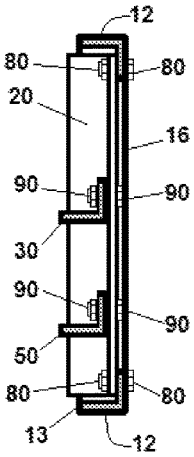
FIG. 1 is a top plan view of a temporary manhole cover according to various example embodiments.
Figure 1:
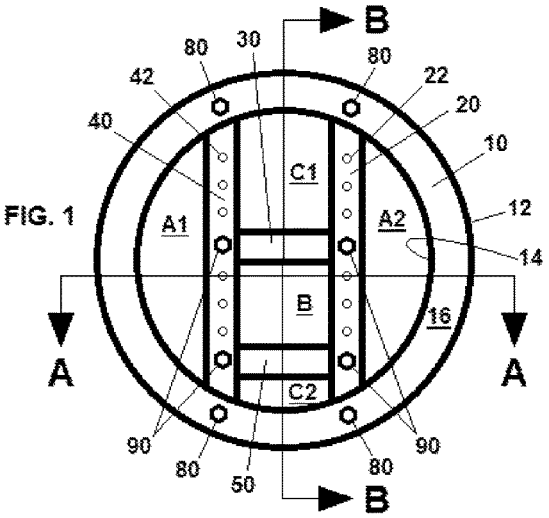
Figure 3:
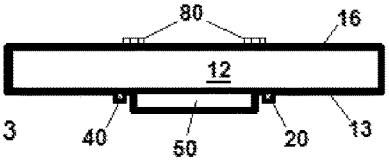
FIG. 3 is a front elevation view of the example temporary manhole cover of FIG. 1.
Figure 4:
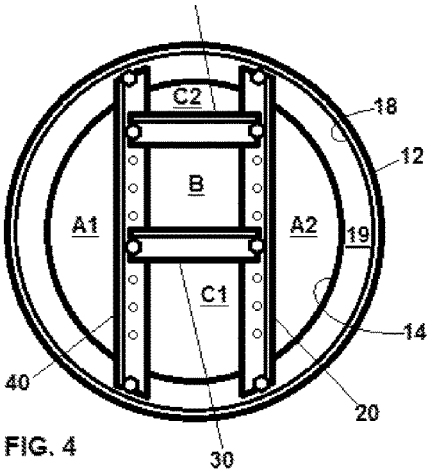
FIG. 4 is a bottom plan view of the example temporary manhole cover of FIG. 1.

Turning to FIGS. 1-4, shown is an illustration of an example embodiment of a temporary manhole cover 100 configured to prevent an entire human body (not shown) from falling into a manhole (see Walsh, FIGS. 1 and 2), while providing a unique structure that allows access for a user (not shown) to reach through and/or pass objects through the temporary manhole cover 100 when it is installed in a manhole (see Walsh, FIGS. 1 and 2). Provided in various example embodiments is a temporary manhole cover 100 comprising, or alternatively consisting of, the components described herein, including annular perimeter portion 10 optionally having an L-shaped cross-section (see FIGS. 1 A-A and 1 B-B) defining a cylindrical wall 12, 18, extending vertically from an upper surface 16 to a lower surface 13 and configured to fit closely within and to engage a circular manhole opening (see Walsh, Inside diameter 20), and a horizontally-extending shelf 19, extending radially inward from an upper surface 16 of the vertically-extending cylindrical wall 12, 18, and defining an interior opening 14 there-through, which may be circular as shown in (FIGS. 1 and 4. In other embodiments (not shown), the annular perimeter portion 10 may have one or more different or additional cross-sectional profiles, such as a rectangle, square, triangle, or any other suitable cross-section(s). A temporary manhole cover 100 may further comprise, or alternatively consist of, a first set of two parallel laterally-separated cross-members 20, 40, each attached via fasteners 80 with and extending from a first side of the horizontally-extending shelf 19, across the optionally circular interior opening 14 to a second side of the horizontally-extending shelf 19, and a second set of two parallel laterally-separated cross-members 30, 50, each extending perpendicularly from and attached via fasteners 90 with a first one 20 of the first set of two parallel laterally-separated cross-members 20, 40, across an interior portion of the interior opening 14 to a second one 40 of the first set of two parallel laterally-separated cross-members 20, 40.

As shown in the '354 Application, tabs, shelves, brackets, or abutments may extend radially inward from the interior surface 18 of the vertically extending wall underneath the ends of the first set of two parallel laterally-separated cross-members 20, 40, to act as a fail-safe support for the first set of two parallel laterally-separated cross-members 20, 40, if the first set of two parallel laterally-separated cross-members 20, 40, were to inadvertently become unfastened from the annular perimeter portion 10.

In various example embodiments the first set of two parallel laterally-separated cross-members 20, 40, or the second set of two parallel laterally-separated cross-members 30, 50, or both, may each have an L-shaped cross-section (see FIGS. 1 A-A and 1 B-B). In other embodiments (not shown), any or all of the cross members 20, 30, 40, 50, may have other cross-sectional profiles, such as any combination(s) of rectangle, square, triangle, circular, solid or hollow tubing, U-channel or C-channel, or any other suitable cross-section(s). In certain example embodiments the annular perimeter portion 10 and laterally-separated cross-members 20, 30, 40, 50, are all formed from commercially-available aluminum angle, or angle-iron. In various example embodiments the various components of the temporary manhole cover 100, such as the annular perimeter portion 10, and laterally-separated cross-members 20, 30, 40, 50, may be formed from any suitable material, preferably lightweight and strong material, such as aluminum. Alternatively, any other suitable material or combinations of materials may be used, such as steel, high-strength plastic, polymer, or composite material.

While for clarity the Figures illustrate the annular perimeter portion 10 and laterally-separated cross-members 20, 30, 40, 50, all being constructed from angle material of the same size, in other embodiments (not shown) cross-members 20, 40, may be made from angle having a smaller cross-section than annular perimeter 10, and cross-members 30, 50, may be made from angle, C-channel, or the like, having a smaller cross-section than cross-members 20, 40, such that the bottom of the temporary manhole cover 100 is flush with or does not extend vertically below lower surface 13; i.e., so that neither cross-members 20, 40, nor cross-members 30, 50, extend past lower surface 13, for instance as depicted in the '354 Application.

Fasteners 80, 90, may be any suitable fastener, such as nuts and bolts, or rivets, or any other suitable fastener, and in certain example embodiments may be configured to be readily removed and replaced with common hand tools (e.g., removable fasteners). In other example embodiments (not shown), fasteners 80, 90, may be omitted in favor of welds or forming the entire structure 100 as one piece. In various example embodiments the second set of two parallel laterally-separated cross-members 30, 50, may be removably attachable to the first set of two parallel laterally-separated cross-members 20, 40, at various predetermined longitudinal locations 22, 42 along the first and second ones of the first set of two parallel laterally-separated cross-members 20, 40. In various example embodiments the resulting temporary manhole cover structure 100 may result in openings there-through, such as five openings in the example embodiment shown in FIGS. 1 and 4.

For example, the five large openings in the example embodiment shown in the accompanying Figures may comprise or consist of:

(A1, A2) two segments of the optionally circular interior opening 14 extending outward from the first set of two parallel laterally-separated cross-members 20, 40, and bounded by the interior opening 14 (i.e., two segments of a circle, the region between a chord of a circle and its associated arc);

(B) one rectangular opening (which may be a square opening) extending inward from the second set of two parallel laterally-separated cross-members 30, 50, and bounded by the first set of two parallel laterally-separated cross-members 20, 40; and (C1, C2) two composite openings that are each the sum of a segment of the circular opening 14 plus a rectangular portion (which may be a square portion), the two composite openings C1, C2, each bounded by: the first set of two parallel laterally-separated cross-members 20, 40; one of the second set of two parallel laterally-separated cross-members, 30 or 50; and the interior opening 14.

In the adjustable example embodiment shown in the Figures, the size of the openings B, C1, and C2, can be varied by moving one or both of the second set of two parallel laterally-separated cross-members, 30, 50, into any of various different predetermined locations 22, 42, for instance by unfastening fasteners 90, moving one or both of the second set of two parallel laterally-separated cross-members, 30, 50, into any of various different locations 22, 42, and refastening fasteners 90 in the new location(s) 22, 42. Also, in alternative example embodiments (not shown), additional laterally-separated cross-members, 30, 50, may be added to the structure 100 to create additional, typically smaller openings B. Alternatively, in another example embodiment (not shown), only one of the laterally-separated cross-members, 30, 50, may be used, thus creating a larger C1 and/or C2.

The resulting structure 100 may be used in the manners described in Walsh and in various other references incorporated in the '354 Application, including by one or more users removing a regular manhole cover from a manhole, placing an example of the present temporary manhole cover 100 on or over the manhole, and then reaching a user's hand or arm through one of the large openings A1, A2, B, C1, C2, in the temporary manhole cover 100. In various example embodiments the user may reach a user's first hand or arm through a first one of the large openings A1, A2, B, C1, C2, in the temporary manhole cover 100 while simultaneously reaching a user's second hand or arm (or a tool or equipment at least as large as the user's hand) through a second one of the large openings A1, A2, B, C1, C2, in the temporary manhole cover 100. In various example embodiments a user below the temporary manhole cover 100 may reach up through or insert a tool or equipment through one of the large openings A1, A2, B, C1, C2, while another user above the temporary manhole cover 100 may reach down through or insert a tool or equipment through one of the large openings A1, A2, B, C1, C2. Simultaneously therewith or alternatively, one or more objects may removably pass through one or more of the large openings A1, A2, B, C1, C2, in the temporary manhole cover 100, such as hoses, wires, or any other suitable object(s). As evident, light, sounds, liquids, and air may pass through the large openings A1, A2, B, C1, C2, as well.

While a plurality of the large openings A1, A2, B, C1, C2, may be large enough for a user's hand or arm to pass through, in various example embodiments none of the large openings A1, A2, B, C1, C2, are large enough for a user's entire body to fall through, thus complying with various safety codes and/or requirements in certain circumstances.

Various example advantages of certain temporary manhole covers 100 constructed according to the presenting invention may include any or all of:

- Allowing work to be conducted harness-free both at and below ground level;
- Eliminating periodic re-certification of anchor points, for instance on vehicles;
- Eliminating falls from heights where work is conducted near or over manholes or sewer or storm water openings;
- Eliminating lengthy set-up in confined spaces and the need for large quantities of equipment;
- Enabling people to move freely while one or more cables or hoses are in use and passing through the temporary manhole cover;
- Easy installation and removal while workers are in confined spaces;
- Self-ventilates and allows passage of natural light there-through;
- Lightweight (various example embodiments may be carried, installed, and removed easily by one person without tools);
- Minimizes paperwork for onsite personnel;
- No need to tie-off, thus no need for harnesses, lanyards nor inertia reels;
- Provides easy access for services, equipment and hoses;
- Reduces exposure to risks and hazards for personnel and their employers;
- Reduces costs of purchasing and servicing equipment;

Reduces training costs; and

Stops large objects, including persons, from falling into confined spaces.

Any of the suitable technologies set forth and incorporated herein may be used to implement various example aspects of the invention as would be apparent to one of skill in the art.

Although exemplary embodiments and applications of the invention are described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. A temporary manhole cover comprising:

an annular perimeter portion defining a vertically-extending cylindrical wall configured to fit closely within and to engage a circular manhole opening;

a horizontally-extending shelf extending radially inward from a top edge of the vertically-extending cylindrical wall to an inner profile surface and defining an interior opening there-through;

a first set of two parallel laterally-separated cross-members, each attached with and extending from a first side of the horizontally-extending shelf, across the interior opening, to and attached with a second side of the horizontally-extending shelf;

a second set of two parallel laterally-separated cross-members, each extending perpendicularly from and attached with a first one of the first set of two parallel laterally-separated cross-members, across an interior portion of the interior opening, to and attached with a second one of the first set of two parallel laterally-separated cross-members;

the temporary manhole cover defining a plurality of openings there-through, including:

a first opening defined between the inner profile surface and the first one of the first set of two parallel laterally-separated cross-members;

a second opening defined between the inner profile surface and the second one of the first set of two parallel laterally-separated cross-members;

a third opening defined between the first set of two parallel laterally-separated cross-members and between the second set of two parallel laterally-separated cross-members;

a fourth opening defined between the inner profile surface, the first set of two parallel laterally-separated cross-members, and a first one of the second set of two parallel laterally-separated cross-members; and a fifth opening defined between the inner profile surface, the first set of two parallel laterally-separated cross-members, and a second one of the second set of two parallel laterally-separated cross-members;

wherein at least two of the plurality of openings are sufficiently large that a user can pass a hand of the user there-through, while none of the plurality of openings are sufficiently large that an entire body of the user can pass there-through; and wherein the second set of two parallel laterally-separated cross-members are each removably attachable with the first set of two parallel laterally-separated cross-members at a plurality of different predetermined locations on the first set of two parallel laterally-separated cross-members.

2. The temporary manhole cover of claim 1, wherein the inner profile surface defines a round interior opening.

3. The temporary manhole cover of claim 1, wherein the annular perimeter portion includes an L-shaped cross-section.

4. The temporary manhole cover of claim 3, wherein the first set of two parallel laterally-separated cross-members each includes an L-shaped cross-section.

5. The temporary manhole cover of claim 4, wherein the second set of two parallel laterally-separated cross-members each includes a U-shaped cross-section.

6. The temporary manhole cover of claim 4, wherein the first set of two parallel laterally-separated cross-members are each formed from angle aluminum.

7. The temporary manhole cover of claim 4, wherein the second set of two parallel laterally-separated cross-members are each formed from C-channel aluminum.

8. The temporary manhole cover of claim 1, wherein no part of the temporary manhole cover extends vertically downward below a bottommost surface of the vertically-extending cylindrical wall of the annular perimeter portion.

9. A method of using a temporary manhole cover, comprising the steps of:

removing a manhole cover from a manhole;

placing on the manhole a temporary manhole cover as recited in claim 1;

reaching a user's hand through any of the plurality of openings in the temporary manhole cover, while simultaneously another object at least the size of the user's hand is extending through any other of the plurality of openings in the temporary manhole cover.

10. A method of using a temporary manhole cover, comprising the steps of:

providing a temporary manhole cover as recited in claim 1;

removing at least one of the second set of two parallel laterally-separated cross-members from a first predetermined location on the first set of two parallel laterally-separated cross-members and attaching the at least one of the second set of two parallel laterally-separated cross-members at a second predetermined location on the first set of two parallel laterally-separated cross-members.

11. The method of claim 3, further comprising the steps of:

removing a manhole cover from a manhole;

placing on the manhole the temporary manhole cover as recited in claim 1;

reaching a user's hand through any of the plurality of openings in the temporary manhole cover, while simultaneously another object at least the size of the user's hand is extending through any other of the plurality of openings in the temporary manhole cover.

* * * * *